US006526686B1

(12) United States Patent
Poff, Jr. et al.

(10) Patent No.: US 6,526,686 B1
(45) Date of Patent: Mar. 4, 2003

(54) POWER STORAGE UNIT CHARGING SYSTEM FOR FIREARM

(75) Inventors: Charles Richard Poff, Jr., Vero Beach, FL (US); John R. Martin, Naples, FL (US); David C. Nethercot, Naples, FL (US)

(73) Assignee: Cape AeroSpace, Cape Coral, FL (US)

( * ) Notice: Subject to any disclaimer, the term of this patent is extended or adjusted under 35 U.S.C. 154(b) by 0 days.

(21) Appl. No.: 09/999,337

(22) Filed: Nov. 1, 2001

(51) Int. Cl.[7] ..... F41A 19/00

(52) U.S. Cl. ..... 42/84; 89/28.05; 89/28.1; 89/135

(58) Field of Search ..... 42/84; 89/28.05, 89/28.1, 135

(56) References Cited

U.S. PATENT DOCUMENTS 3,987,729 A * 10/1976 Andrews et al. ..... 102/210
5,040,463 A * 8/1991 Beaverson ..... 102/210
5,838,138 A * 11/1998 Henty ..... 320/107

* cited by examiner

*Primary Examiner*—J. Woodrow Eldred
(74) *Attorney, Agent, or Firm*—Price, Heneveld, Cooper, DeWitt & Litton

(57) ABSTRACT

An electric charging system for a firearm includes a port in operable communication with a chamber adapted to receive an amount of expanding gas created by an ignited charge, and a cavity in operable communication with the port and adapted to receive an amount of the expanding gas therefrom. The charging system also includes a charging assembly in operable communication with the cavity, wherein the charging assembly creates an electric charge when impinged by the expanding gas located within the cavity, and a conductor in electrical communication with the charging assembly, wherein the conductor receives the electrical charge from the charging assembly. The charging system further includes a power storage unit in electrical communication with the conductor, wherein the storage unit stores the electrical charge received from the conductor.

40 Claims, 4 Drawing Sheets

POWER STORAGE UNIT CHARGING SYSTEM FOR FIREARM

BACKGROUND OF THE INVENTION

The present invention relates to a firearm containing a power storage unit therein, and in particular to a charging system for charging the power storage unit located within the firearm.

Semiautomatic and automatic firearms typically include a bolt assembly that includes things such as a bolt carrier, bolt extractor, ejector, firing pin, etc. Upon firing of the associated firearm, a portion of the expanding gas following a projectile down the barrel is directed back to the bolt assembly, thereby providing the force required to eject a spent shell casing from the firing chamber of the associated firearm and replace the spent cartridge with a new shell. Other firearms such as bolt action and single-shot firearms also generate such force, however, these types of firearms do not utilize direct forces for purposes of unloading and loading.

Numerous kinds of powered scopes are utilized with the modern firearms of today, including infrared scopes, heat-sensing scopes, laser/range finding scopes and "night-vision" scopes. Each of the powered scopes requires that a power source be located within the firearm or carried externally by the user. If these scopes are used for an extended period of time, replacement power units must be provided and/or recharging facilities must be located. Drawbacks to non-rechargeable sources include requiring the operator to carry replacement power sources such as batteries, while rechargeable sources requires the user to find a power source which may not be available.

Therefore, it would be advantageous to develop an electric charging system that utilizes the force generated by the firing of an associated firearm to charge a power storage unit located within the firearm.

SUMMARY OF THE INVENTION

One aspect of the present invention is to provide an electric charging system for a firearm that includes a port in operable communication with a chamber adapted to receive an amount of expanding gas created by an ignited charge.

Another aspect of the present invention is to provide a firearm including a power charging system, the firearm including a bolt assembly and a barrel having an internal bore and operably connected to the bolt assembly. The firearm also includes a port in operable communication with the bore, the bore adapted to receive an amount of expanding gas created by an ignited charge, and a cavity in operable communication with the port and adapted to receive an amount of expanding gas therefrom. The charging system also includes a charging assembly in operable communication with the cavity, wherein the charging assembly creates an electric charge when impinged by the expanding gas located within the cavity, and a conductor in electrical communication with the charging assembly, wherein the conductor receives the electric charge from the charging assembly. The charging system further includes a power storage unit in electrical communication with the conductor, wherein the storage unit stores the electrical charge received from the conductor Yet another aspect of the present invention is to provide an improvement to a firearm that includes a bolt assembly, a barrel in operable communication with the bolt assembly, and having an internal bore, a gas tube in fluid communication with the internal bore of the barrel and the bolt assembly, wherein the gas tube is adapted to receive an amount of expanding gas from the barrel as created by an ignited charge. The improvement includes a port in fluid communication with the internal bore of the barrel and adapted to receive an amount of the expanding gas created by the ignited charge, and a cavity in fluid communication with the port and adapted to receive an amount of the expanding gas therefrom. The improvement also includes a charging assembly in operable communication with the cavity, wherein the charging assembly creates an electric charge when impinged on by the expanding gas located within the cavity, and a power storage unit in electrical communication with the charging assembly and adapted to store the electrical charge created by the charging assembly.

The present inventive charging system provides a standardized power source that may be utilized within numerous weapon systems, eliminates the requirement of the user carrying reserve power sources, eliminates the necessity of replacing expired power sources, and provides a multi-function power supply that is rugged, reliable, and lightweight. The charging system further provides a rechargeable power storage unit that is readily adaptable to existing weapon systems, is applicable to all gas operated, or ported barrel weapons, and is particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
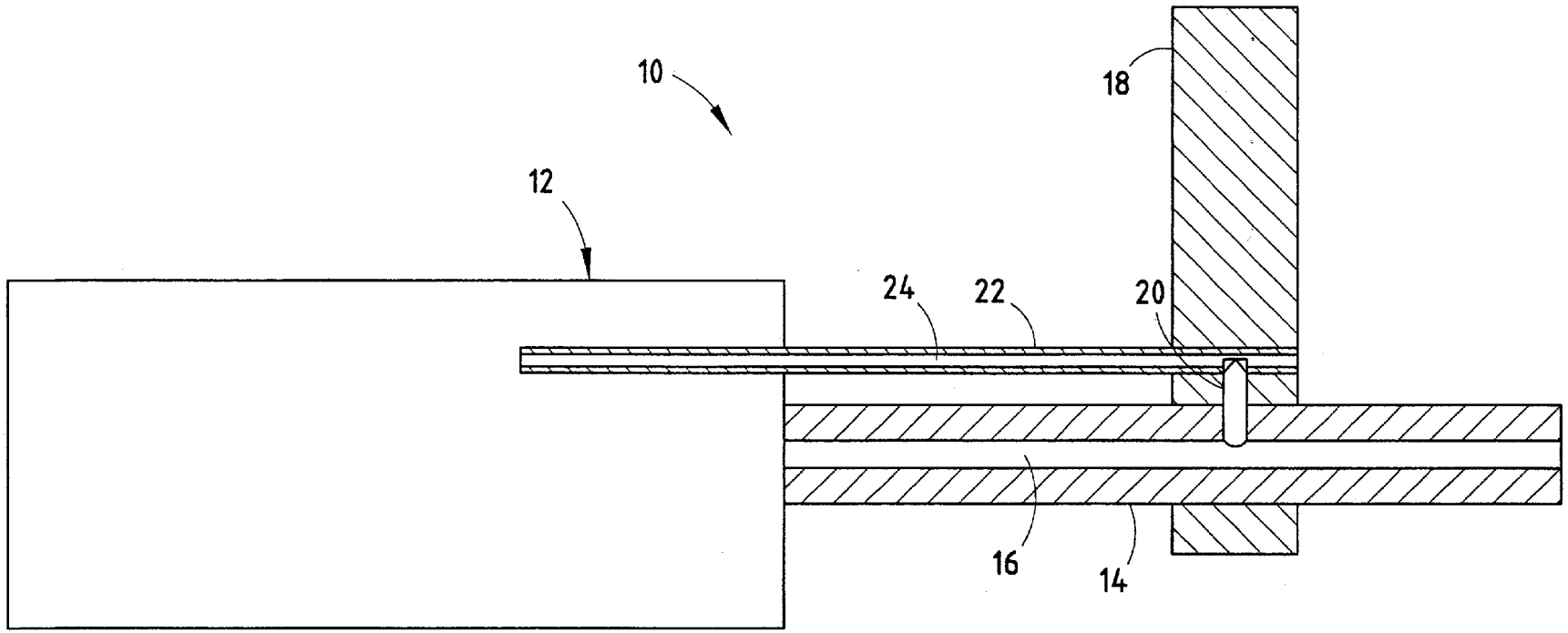
FIG. 1 PRIOR ART
FIG. 1 is a partial schematic side elevational view of a prior art firearm, including a front hand guard assembly, a barrel, a gas block, and a gas tube.

For purposed of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a typical semiautomatic or automatic firearm assembly. It should be noted that while the present invention is described with respect to semi-automatic and automatic firearms, the charging system may also be utilized within other types of firearms including, but in no way limited to, bolt action and single shot firearms. Firearm assembly 10 includes a bolt or breaching assembly 12 (shown schematically) that includes things such as a bolt carrier (not shown), bolt extractor (not shown), ejector (not shown), firing pin (not shown), firing chamber (not shown), and the like typically associated with semiautomatic and automatic firearms. Firearm assembly 10 further includes a barrel 14 fixedly attached with bolt assembly 12 and having an internal bore 16 in operable communication with the firing chamber (not shown). Firearm assembly 10 further includes a gas block 18 fixedly attached with firearm 10 and having a gas exhaust hole or gas port 20 in fluid communication with internal bore 16 of barrel 14. A gas tube 22 extends between gas block 18 and bolt assembly 12. An internal passage 24 located within gas tube 22 provides fluid communication between gas port 20 and bolt assembly 12 as is well known in the art.

Figure 2:
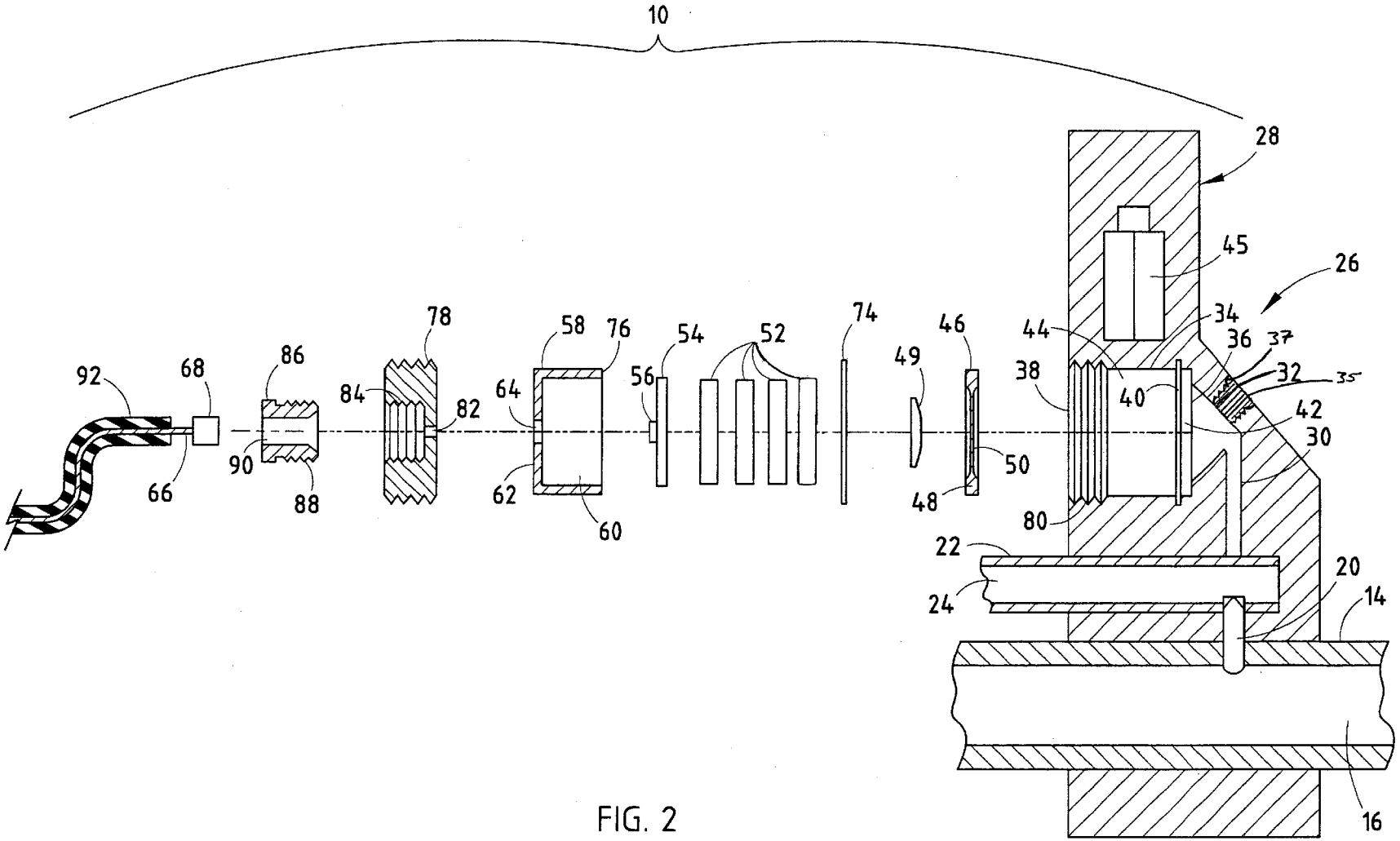
FIG. 2 is a partial schematic, partial cross-sectional exploded side elevational view of the charging system.
Figure 3:
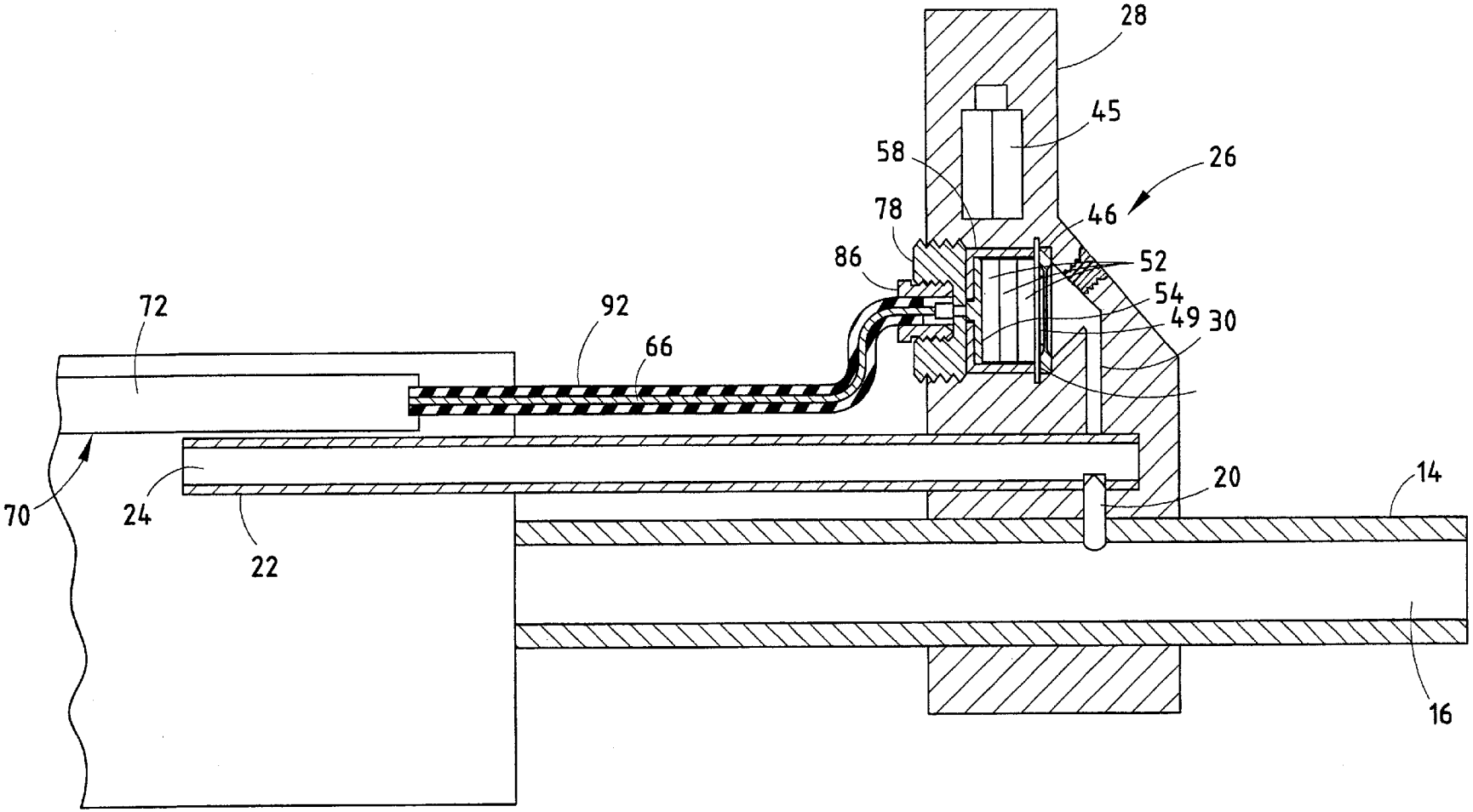
FIG. 3 is a partial schematic side elevational view of a firearm assembly with an electric charging system embodying the present invention.

The reference number 26 (FIGS. 2 and 3) generally designates an electric charging system 26 embodying the present invention. In the illustrated example, the gas block 18 of firearm assembly 10 is replaced with a sight/gas block 28. The sight/gas block 28 includes an internal passage 30 that provides fluid communication between internal passage 24 of gas tube 22 and a conically shaped cavity 32 located within sight/gas block 28. Cavity 32 opens into and is in fluid communication with a tubular shaped cavity 34 having a first end 36 and a second end 38 that defines a circularly shaped aperture within sight/gas block 28. It should be noted that while cavities 32 and 34 are described herein as having particular geometrical shapes, other shapes may be utilized. An access plug 35 is threadably engaged within a threaded access aperture 37 located within sight/gas block 28. Aperture 37 provides access to cavity 32 allowing cleaning thereof. Cavity 34 further includes a snap-ring groove 40 that divides cavity 34 into a first portion 42 and second portion 44.

The charging system 26 further includes a pressure diagram 46 having a thick outer ring 48 circumferentially extending about a thin interior baffle 50. Diagram 46 is preferably constructed of steel, however, other suitable materials may be utilized. Charging system 26 further includes a steel spring washer 49 having an outer diameter that is slightly smaller than the outer diameter of the interior baffle 50 of diagram 46.

The charging system 26 further includes a plurality of piezo electric crystals 52 that provide an electric charge when under compression. A conductor element 54 abuts crystals 52 and is in electrical communication therewith. Conductor element 54 includes an electrode 56. A cup-shaped insulator cap 58 is configured to receive conductor 54 and crystals 52 within an interior 60 thereof. Cap 58 also includes an end wall 62 having a centrally located aperture 64 extending therethrough. Electric charging system 28 further includes an electrical lead wire 66 having an electrode 68 connected thereto and in electrical communication therewith. Electrode 68 is adapted to electrically and physically connect with electrode 56 of conductor element 54. Lead wire 66 is in electrical communication with a power storage unit 70.

Figure 4:
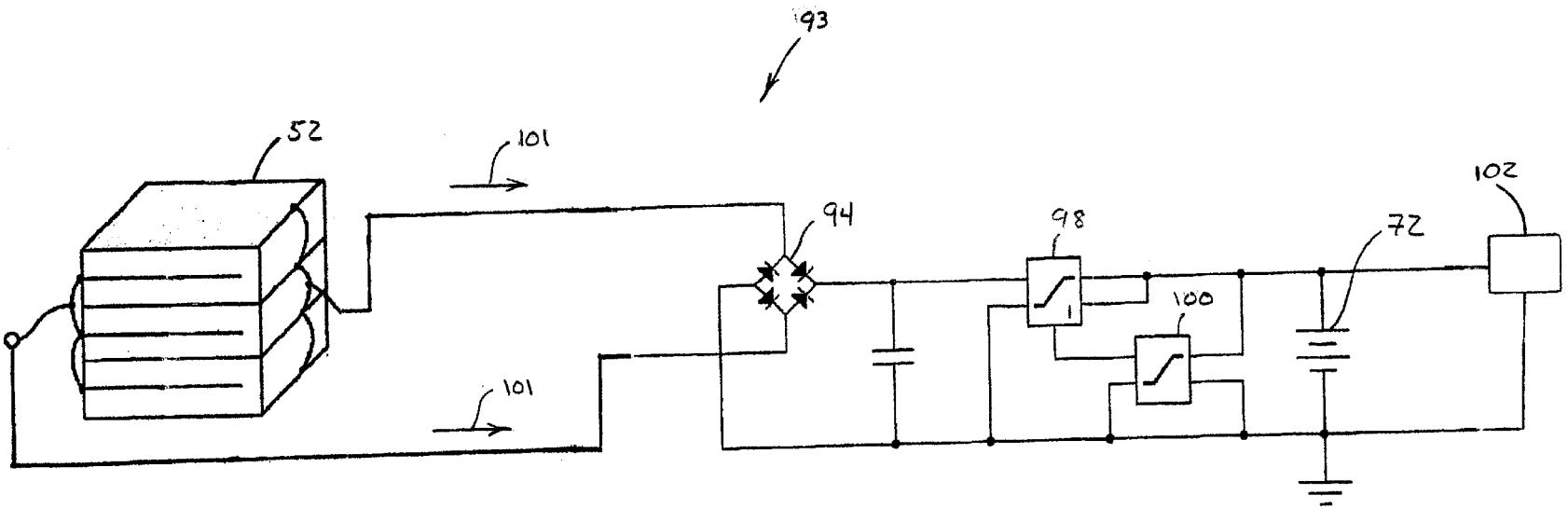
FIG. 4 is a schematic view of a power charging circuit.

In the illustrated example, the power storage unit 70 (FIG. 4) includes a rechargeable battery pack 72 and a power charging circuit 93. Power charging circuit 93 includes a bridge rectifier circuit 94, a capacitor 96, a current limiter 98, and a voltage monitor 100. Specifically, the voltage and associated current traveling in a direction indicated by arrow 101 generated by the crystals 53 is first directed to bridge rectifier circuit 94 which rectifies the polarity of the current from crystals 53, thereby delivering the same polarity to the battery 72 at all times of compression and decompression of crystals 53. Capacitor 96 then receives the rectified current from rectifier circuit 94. In the illustrated example, capacitor 96 is adapted to withstand high voltages, and shields battery 72 from directly receiving such voltages which may damage battery 72. The voltage is then delivered to the constant current or current limiting circuit 98, thereby effectively shielding battery 72 from a high voltage output from crystals 53. Voltage monitor 100 prevents an overcharge of battery 72. As illustrated in FIG. 4, battery 72 is in electrical communication with any such device 102 within firearm assembly 10 requiring power. Power storage unit 70 is shown within bolt assembly 12 for illustration purposes only, and may be located at any location within the firearm providing adequate space or within an external unit carried by the operator.

In assembly, diaphragm 46 is held within first portion 42 of cavity 34 by a snap ring 74 that is adapted to be snappingly received within snap ring groove 40. Cap 58 is placed within second portion 44 of cavity 34 and houses insulator 54 and crystals 52 therein. When assembled, an end face 76 of cap 58 abuts snap ring 74 and spring washer 49 is frictionally held between crystals 52 and interior baffle 50 of diaphragm 46. Cup 58 is held within second portion 44 of cavity 34 by a threaded end cover 78 that is threadably received within a plurality of threads 80 extending inwardly from second end 38 of cavity 34. End cover 78 includes a centrally located aperture 82 for receiving lead wire 66 therethrough and a centrally located threaded aperture 84. A tube connector 86 is threadably connected within aperture 84 of end cover 78 via a plurality of threads 88. A centrally located aperture 90 extends through tube connector 84 and is adapted to receive an outer tube 92 therein. Outer tube 92 surrounds lead wire 66 and is adapted to protect the same. Lead wire 66 extends through outer tube 92, aperture 82 of end cover 78 and aperture 64 of cap 58, where electrode 68 is physically connected with electrode 56 of conductor element 54.

In operation, the power storage unit 70 is provided with an electrical charge each and every time the associated firearm is fired. Specifically, a portion of the expanding gases caused by the ignition of the propellant of a shell located within the firing chamber of the associated firearm is ported from internal bore 16 of barrel 14 via gas port 20 and internal passage 30 to cavity 32. The expanding gas within cavity 32 impinges and places pressure upon interior baffle 50 of diaphragm 46 causing interior baffle 50 to flex away from cavity 32 and into cavity 34. As interior baffle 50 of diaphragm 46 flexes into cavity 34 a pressure is placed upon spring washer 49, which is in turn placed upon crystal 52, thereby compressing crystals 52 between spring washer 49 and end wall 62 of cap 58. The crystals 52 create an electrical charge when under compression, which is in turn conducted to conductor element 54. The electrical charge is then transmitted via electrode 56 of conductor element 54 to electrode 68 of wire 66, and is in turn conducted to power storage unit 70, thereby recharging power unit 70.

The charging system 26 as disclosed herein may be used in conjunction with numerous attachments used in association with firearms, including but in no way limited to, infrared scopes, heat vision scopes, laser scopes, night vision scopes, range find equipment, charge ignition systems, directional finding equipment and the like.

The charging system 26 provides a standardized power source that can be used within numerous kinds and types of firearms, and eliminates the necessity of the user to carry back up battery, thereby resulting in lighter loads and greater liability. The charging system 26 also eliminates the requirement of changing batteries or power units, provides a multifunction power supply that is rugged, reliable and lightweight and extends the life expectancy of existing equipment. The charging system 26 further extends the operational limits of the associated weapon system that would limit access to replace power storage units, may be readily adapted to existing weapon systems and is applicable to all gas operated, or ported barrel weapons.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An electric charging system for a firearm, comprising:

a port in operable communication with a chamber adapted to receive an amount of expanding gas created by an ignited charge;

a cavity in operable communication with the port and adapted to receive an amount of the expanding gas therefrom;

a charging assembly in operable communication with the cavity, the charging assembly creating an electric charge when impinged by the expanding gas located within the cavity;

a conductor in electrical communication with the charging assembly, the conductor communicating the electric charge from the charging assembly; and a power storage unit in electrical communication with the conductor, the storage unit storing the electrical charge received from the conductor.

2. The charging system of claim 1, wherein the charging assembly includes at least one piezo electric crystal.

3. The charging system of claim 2, further including:

a flexible member in communication with the cavity and adapted to deform when impinged on by the expanding gas, and wherein the flexible member compresses the piezo electric crystal when impinged on by the expanding gas.

4. The charging system of claim 3, wherein the storage unit includes a battery.

5. The charging system of claim 4, further including:

a rectifying circuit that rectifies the polarity of a voltage as produced by the charging assembly.

6. The charging system of claim 5, further including:

a current limiter that receives the electrical charge from the charging assembly prior to the electrical charge being received by the power storage unit.

7. The charging system of claim 6, further including;

a voltage regulator in electrical communication with the power storage unit and that prevents the power storage unit from being charged beyond a predetermined point.

8. The charging system of claim 7, wherein the chamber includes a barrel of a firearm.

9. The charging system of claim 8, wherein the cavity is at least in part defined by a housing that includes a mount for a front site of the firearm.

10. The charging system of claim 9, wherein the cavity is at least in part defined by an insulating cap that is received by the housing, and wherein the cap insulates the piezo crystal and the conductor.

11. The charging system of claim 1, wherein the chamber includes a barrel of a firearm.

12. The charging system of claim 1, wherein the storage unit includes a battery.

13. The charging system of claim 1, further including:

a rectifying circuit that rectifies the polarity of a voltage as produced by the charging assembly.

14. The charging system of claim 1, further including:

a current limiter that receives the electrical charge from the charging assembly prior to the electrical charge being received by the power storage unit.

15. The charging system of claim 1, further including:

a voltage regulator in electrical communication with the power storage unit and that prevents the power storage unit from being charged beyond a predetermined point.

16. The charging system of claim 1, wherein the charging assembly and the conductor are housed within an insulating cap.

17. A firearm including a power charging system, comprising:

a bolt assembly;

a barrel having an internal bore and operably connected to the bolt assembly;

a port in operable communication with the bore, the bore adapted to receive an amount of expanding gas created by an ignited charge;

a cavity in operable communication with the port and adapted to receive an amount of the expanding gas therefrom;

a charging assembly in operable communication with the cavity, the charging assembly creating an electric charge when impinged by the expanding gas located within the cavity;

a conductor in electrical communication with the charging assembly, the conductor communicating the electric charge from the charging assembly; and a power storage unit in electrical communication with the conductor, the storage unit storing the electrical charge received from the conductor.

18. The firearm of claim 17, wherein the charging assembly includes at least one piezo electric crystal.

19. The firearm of claim 18, further including:

a flexible member in communication with the cavity and adapted to deform when impinged on by the expanding gas, and wherein the flexible member compresses the piezo electric crystal when impinged on by the expanding gas.

20. The firearm of claim 19, wherein the storage unit includes a battery.

21. The firearm of claim 20, further including:

a rectifying circuit that rectifies the polarity of a voltage as produced by the charging assembly.

22. The firearm of claim 21, further including:

a current limiter that receives the electrical charge from the charging assembly prior to the electrical charge being received by the power storage unit.

23. The firearm of claim 22, further including:

a voltage regulator in electrical communication with the power storage unit and that prevents the power storage unit from being charged beyond a predetermined point.

24. The firearm of claim 23, wherein the cavity is at least in part defined by a housing that includes a mount for a front site of the firearm.

25. The firearm of claim 24, wherein the cavity is at least in part defined by an insulating cap that is received by the housing, and wherein the cap insulates the piezo crystal and the conductor.

26. The firearm of claim 17, wherein the storage unit includes a battery.

27. The firearm of claim 17, further including:

a rectifying circuit that rectifies the polarity of a voltage as produced by the charging assembly.

28. The firearm of claim 17, further including:

a current limiter that receives the electrical charge from the charging assembly prior to the electrical charge being received by the power storage unit.

29. The firearm of claim 17, further including:

a voltage regulator in electrical communication with the power storage unit and that prevents the power storage unit from being charged beyond a predetermined point.

30. The firearm of claim 17, wherein the charging assembly and the conductor are housed within an insulating cap.

31. The firearm of claim 17, wherein the cavity is at least in part defined by a housing that includes a mount for a front site of the firearm.

32. An improvement to a firearm that includes a bolt assembly, a barrel in operable communication with the bolt assembly and having an internal bore, a gas tube in fluid communication with the internal bore of the barrel and the bolt assembly, the gas tube adapted to receive an amount of expanding gas from the barrel as created by an ignited charge, the improvement comprising:

a port in fluid communication with the internal bore of the barrel and adapted to receive an amount of the expanding gas created by the ignited charge;

a cavity in fluid communication with the port and adapted to receive an amount of the expanding gas therefrom;

a charging assembly in operable communication with the cavity, the charging assembly creating an electric charge when impinged on by the expanding gas located within the cavity; and a power storage unit in electrical communication with the charging assembly and adapted to store the electrical charge created by the charging assembly.

33. The improvement of claim 32, wherein the charging assembly includes at least one piezo electric crystal.

34. The improvement of claim 33, wherein the charging assembly further includes a flexible member in operable communication with the cavity and adapted to deform when impinged on by the expanding gas, and wherein the flexible member compresses the piezo electric crystal when impinged on by the expanding gas.

35. The improvement of claim 34, further including:

a conductor in electrical communication with the charging assembly and the storage unit, and adapted to communicate the electric charge from the charging assembly to the storage unit.

36. The improvement of claim 35, wherein the power storage unit includes a battery.

37. The improvement of claim 36, further including:

a rectifying circuit that rectifies the polarity of a voltage as produced by the charging assembly.

38. The improvement of claim 37, further including:

a current limiter that receives the electrical charge from the charging assembly prior to the electrical charge being received by the power storage unit.

39. The improvement of claim 17, further including:

a voltage regulator in electrical communication with the power storage unit and that prevents the power storage unit from being charged beyond a predetermined point.

40. The improvement of claim 32, wherein the cavity is at least in part defined by a housing that includes a mount for a front site of the firearm.

* * * * *